United States Patent [19]

Baron

[11] Patent Number: 4,595,050

[45] Date of Patent: Jun. 17, 1986

[54] HEAT EXCHANGER TUBE CLEANING ELEMENT CAPTURING DEVICE WITH RETAINER ROTATION PREVENTION

[75] Inventor: Walter J. Baron, Mequon, Wis.

[73] Assignee: Water Services of America, Inc., Milwaukee, Wis.

[21] Appl. No.: 645,823

[22] Filed: Aug. 31, 1984

Related U.S. Application Data

[63] Continuation-in-part of Ser. No. 533,134, Sep. 16, 1983, abandoned, and a continuation-in-part of Ser. No. 533,143, Sep. 16, 1983, abandoned.

[51] Int. Cl.[4] ..... F28G 1/12

[52] U.S. Cl. ..... 165/95; 15/3.51

[58] Field of Search ..... 165/95, 175; 15/3.51, 15/104.06 R; 137/15, 242, 244

[56] References Cited

U.S. PATENT DOCUMENTS 4,418,747 12/1983 Baron et al. ..... 165/95

4,489,776 12/1984 Baron ..... 165/95

*Primary Examiner*—Allen M. Ostrager

*Attorney, Agent, or Firm*—Andrus, Sceales, Starke & Sawall

[57] ABSTRACT

A heat exchanger (1) has a plurality of fluid flow tubes (5) secured adjacent their ends by tube sheets (6, 7). Cleaning elements (18) are adapted to shuttle back and forth in the tubes and are adapted to be captured by elongated slotted baskets (17). A removable cleaning element retainer (28) is adapted to be snap fit into the end of each basket via flexible clip legs (30) terminating in radially outwardly extending prongs (31). A notch (39) formed in the outer slot end receives a retainer prong and thereby holds the retainer against basket-wearing rotation.

5 Claims, 7 Drawing Figures

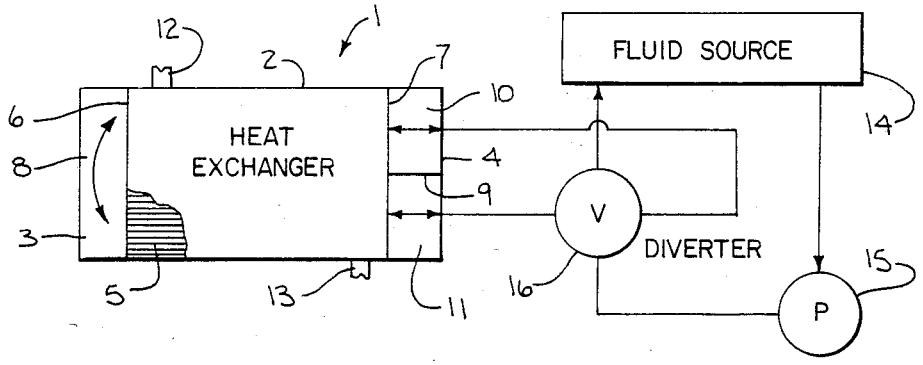
FIG. 1
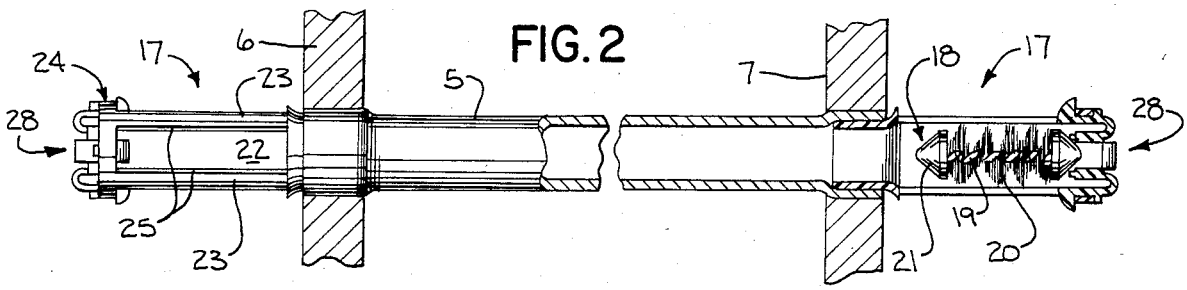
FIG. 2
FIG. 3 PRIOR ART
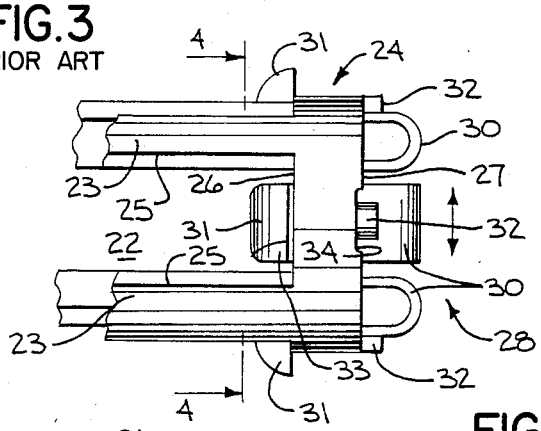
FIG. 6
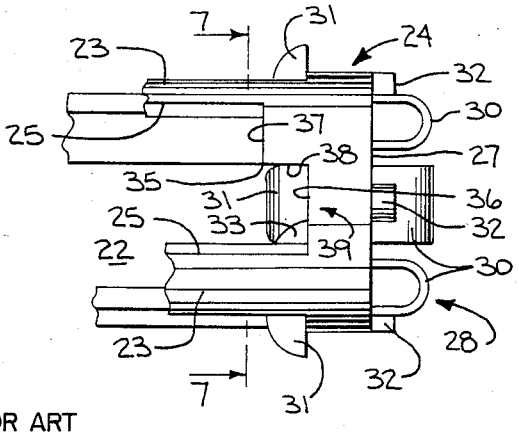
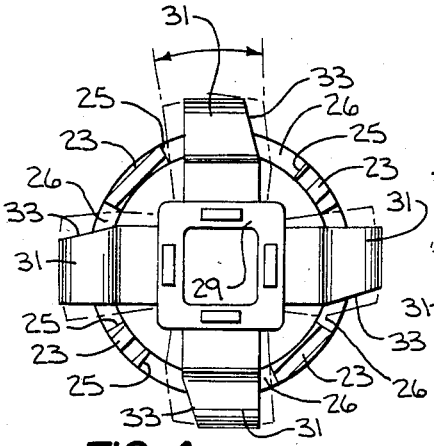
FIG. 4 PRIOR ART
FIG. 5 PRIOR ART
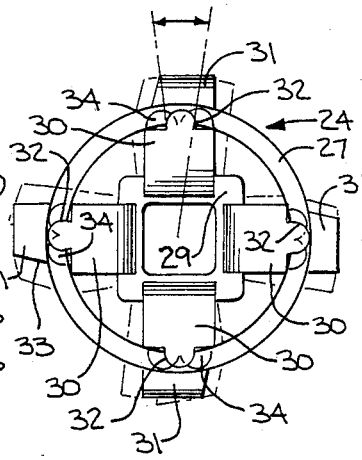
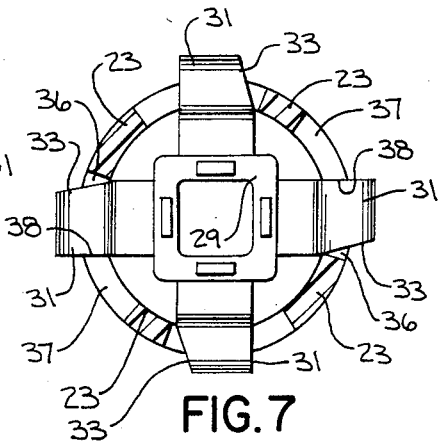
FIG. 7

HEAT EXCHANGER TUBE CLEANING ELEMENT CAPTURING DEVICE WITH RETAINER ROTATION PREVENTION

This is a continuation-in-part application of Ser. No. 06/533,134, filed Sept. 16, 1983, inventor, Walter J. Baron, entitled HEAT EXCHANGER TUBE CLEANING ELEMENT CAPTURING DEVICE WITH RETAINER ROTATION PREVENTION, now abandoned, and Ser. No. 06/533,143, filed Sept. 16, 1983, inventor, Walter J. Baron, entitled ALIGNMENT OF BASKET RETAINER CLIPS FOR HEAT EXCHANGER TUBE CLEANING ELEMENTS, now abandoned.

U.S. PRIOR ART OF INTEREST

| U.S. Pat. No. | Inventor | Issue Date |
|---|---|---|
| 3,319,710 | Heeren et al. | May 16, 1967 |
| 4,124,065 | Leitner et al. | Nov. 7, 1978 |

Background And Summary Of The Invention

This invention relates to an improved heat exchanger tube cleaning element capturing device.

It is known from the above-identified patents to connect individual elongated cleaning element capturing cages or baskets to both ends of longitudinally extending tubes disposed in a heat exchanger housing. The tube ends are held in position at both ends by transverse tube sheets. The baskets are adapted to contain shuttleable cleaning elements such as brushes. Fluid flowing in one direction through the tubes keeps the cleaning elements captured within their respective basket chambers, while the fluid discharges outwardly through openings in the basket walls. Upon reversal of fluid flow, the cleaning elements are forced out of their baskets and through the tubes to the baskets at the opposite tube ends to thereby perform a tube cleaning action.

Many baskets are designed of plastic and with their elongated body portions formed by alternating ribs and fluid flow-through slots which terminate in an annular outer end ring. The inner edge portion of the ring is alternately joined to the ribs or exposed to form the outer slot ends. For purposes of retaining a cleaning element within the basket and yet allowing the cleaning element to be removed for more complete access to the tube interiors, a retainer has been removably attached to the outer basket end. One form of retainer has comprised a central body supporting a plurality of flexible clip legs which extend longitudinally inwardly. The clip legs are provided with end prongs and stop projections spaced therefrom. When the retainer is assembled onto the basket, the prongs snap into the slots and the stop projections engage the outer edge of the basket end ring to limit entry of the retainer into the basket.

Heretofore, the relative width of the basket slots and prongs has been such that the retainer was free to rotate a distance limited by the width of the slots. It has been found that operation of the heat exchanger over a period of time with pressurized fluid impinging on the basket assembly has caused the stop projections to cut or dig into the basket ring edge to the point where the ring was either substantially weakened or broken through. This phenomenon is believed to be due to vibrations of the retainer caused by the fluid flowing at high velocity, said vibrations causing the retainer to oscillatingly rotate back and forth.

It is an object of the present invention to eliminate the undesirable damage to the basket by the retainer.

In accordance with the various aspects of the invention, means are provided to hold the retainer in a fixed annular position so that a clip leg cannot oscillate between slot edges during operation of the system, thus eliminating the wearing of the basket ring by the retainer. In the present embodiment, at least one outer slot end is provided with a longitudinally inwardly extending stepped portion forming, with one slot edge, a narrow notch within which the retainer prong is confined so that it cannot rotate.

BRIEF DESCRIPTION OF THE DRAWINGS

The accompanying drawings illustrate the best mode presently contemplated by the inventor for carrying out the invention.

In the drawings:

FIG. 1 is a schematic showing of a heat exchanger and fluid flow controls therefor;

FIG. 2 is a longitudinal section through a typical heat exchanger tube mounted in fragmentarily shown tube sheets where the tube has a capturing chamber connected at each end and in one of which chambers there is a tube cleaning element;

FIG. 3 is an enlarged fragmentary side elevation of the basket-retainer assembly of the previously known type;

FIG. 4 is a transverse section taken on line 4—4 of FIG. 3;

FIG. 5 is an end view of the assembly of FIGS. 3 and 4;

FIG. 6 is a view similar to FIG. 3 of an assembly constructed in accordance with the present invention; and FIG. 7 is a transverse section taken on line 7—7 of FIG. 6.

DESCRIPTION OF THE PREFERRED EMBODIMENT

The present invention is directed to tube-type heat exchangers such as steam condensers or the like. A schematic showing of such an exchanger and its fluid flow controls is shown in FIG. 1. The exchanger 1 comprises a cylindrical housing 2 having end closure heads 3 and 4, and a plurality of longitudinally extending tubes 5 therein. The exposed open ends of tubes 5 are connected to transverse tube sheets 6 and 7 which are spaced from the respective end heads 3 and 4. Head 3 and tube sheet 6 form one fluid flow chamber 8, while a partition 9 separates the space between head 4 and tube sheet 7 into a pair of fluid flow chambers 10 and 11. Heat exchanging fluid is introduced through an inlet 12 to the area around tubes 5 and discharges through an outlet 13.

Heat exchanger 1 is also connected to a fluid source 14, a pump 15 and a fluid diverter valve 16 by various conduits in the conventional manner. Fluid is directed through tubes 5 via chambers 10, 8 and 11, in that order or in reverse order, depending on the position of valve 16.

Heat exchanger 1 is provided with tube cleaning means. For this purpose, and as shown in FIG. 2, a plurality of assemblies are disposed in chambers 8, 10 and 11 and include longitudinally extending elongated baskets 17 which are mounted to tube sheets 6 and 7 so that they are in fluid communication with the interiors of tubes 5.

Each pair of opposed baskets 17 is adapted to capture and hold a shuttling cleaning element, such as a brush 18, which moves back and forth between the basket pair through the respective tube 5, depending upon the setting of valve 16. FIG. 2 illustrates one brush 18 disposed in one end basket 17. Brush 18 generally comprises a stem 19 holding an elongated spiral array of brush bristles 20 and conical end caps 21.

Referring to FIGS. 2–5, each basket 17 has a central body portion comprising a plurality of alternate fluid flow slots 22 and ribs 23 which terminate at their outer ends in an annular ring 24 forming the outer end portion of the basket. Opposing ribs 23 are shown as having slightly different widths. Each slot 22 is delineated by longitudinal elongated side edges 25 formed by a pair of ribs 23, and an outer end edge 26 formed by an inner edge portion of ring 24. Ring 24 also has an annular outer edge 27.

For purposes of at least partially closing the outer basket opening, a removable cleaning element retainer 28 is mounted to the basket end. As shown, retainer 28 includes a central body portion 29 from which extends a plurality of flexible looped clip legs 30. Legs 30 extend longitudinally inwardly in general parallelism and are provided with radially outwardly extending end prongs 31 which are adapted to snap over the respective slot end edges 26 when retainer 28 is inserted into basket 17. Narrow projections 32 are disposed on clip legs 30 and are spaced longitudinally outwardly from prongs 31 a distance approximately equal to the width of ring 24 so that the latter is confined therebetween. Projections 32 function as stop means to limit the entry of retainer 28 into basket 17.

Removal of retainer 28 from basket 17 is facilitated by ramps 33 on prongs 31 so that upon turning of the retainer the ramps will ride up the rib edges 25 for flexing release of clip legs 30.

In the known construction of FIGS. 3–5, slots 22 are wider than clip legs 30 and prongs 31. Thus, during high velocity fluid flow through the basket-retainer asembly, retainer 28 tends to rotate so that prongs 31 move back and forth between rib edges 25, as shown by the arrows and dash lines. At the same time, and as shown in FIG. 5, and especially when the fluid flow is directed into the end of basket 17, projections 32, which also rotate, have been found to gradually dig or cut into outer edge 27 of ring 24, as at 34.

The present invention eliminates the undesirable weakening of ring 24 by providing means to hold retainer 28 in fixed annular position relative to basket 17. For this purpose, at least one retainer prong 31 and the end portion of basket 17 are constructed to cooperate to lock the prong in fixed position.

The present embodiment utilizes notch means on the basket to hold prong 31 from rotating. As shown in FIGS. 6 and 7, the outer end of each of a pair of opposing slots is provided with a stepped edge 35 comprising an outer transverse edge portion 36, an inner transverse edge portion 37 disposed longitudinally inwardly from portion 36 and displaced circumferentially therefrom, and a longitudinally extending edge portion 38 joining portions 36 and 37.

Edge portions 36 and 38 cooperate with a corner of rib edge 25 to form a notch 39 which is of essentially the same width as a prong 31 which fits therein when retainer 28 is snapped into place. Thus, the opposed prongs 31 are captured so that retainer 28 and projections 32 cannot rotate.

Although two of slots 22 are shown as having stepped edges 35, any number of the slots may be so provided.

The concepts of the invention solve the problem of wearing away of the end edge of a cleaning element receiving basket in a unique and effective manner.

While a basket separate from the tube end is shown in the drawings, a basket integral with the tube could be utilized without departing from the spirit of the invention.

Various modes of carrying out the invention are contemplated as being within the scope of the following claims particularly pointing out and distinctly claiming the subject matter which is regarded as the invention.

I claim:

1. For use in a heat exchanger having a housing containing a plurality of fluid flow tubes arranged with exposed open ends, the combination comprising:

(a) an elongated basket adapted to capture a tube cleaning element propelled through the tube by fluid, (b) said basket having a longitudinally extending central body portion comprising a fluid flow slot and ribs forming the side edges of said slot, (c) a cleaning element retainer adapted to be removably mounted to the outer end of said basket and with said retainer including a flexible clip leg, (d) and cooperative means disposed at the outer end of said slot and on said clip leg for fixedly holding said retainer stationary with respect to said basket when the retainer is mounted to said basket.

2. The combination of claim 1 wherein:

(a) said cooperative means disposed on said clip leg comprises a radially outwardly extending prong adapted to snap into said slot, (b) and said cooperative means disposed at the outer end of said slot comprises a notch of essentially the same width as said prong for receiving said prong thereinto.

3. The combination of claim 2 wherein said notch includes a stepped edge disposed at the outer end of said slot.

4. The combination of claim 3 wherein said notch further includes a said side edge of said slot so that a said snapped-in prong is confined against rotation by a portion of said stepped edge and said last-named side edge of said slot.

5. The combination of claim 1 or 4 wherein:

(a) said fluid flow slot and ribs terminate outwardly in an annular ring, (b) said clip leg includes a projection forming a stop engageable with said ring when said retainer is mounted to said basket, (c) and said first-named cooperative means comprises means to essentially eliminate wearing of said ring by said projection during fluid flow through said basket.

* * * * *